US006550094B1

(12) United States Patent
Hurtado

(10) Patent No.: US 6,550,094 B1
(45) Date of Patent: Apr. 22, 2003

(54) MOP WITH BATTERY POWERED WRINGER

(76) Inventor: Arthur Hurtado, 7750 Big Rock Dr., Riverside, CA (US) 92509

( * ) Notice: Subject to any disclaimer, the term of this patent is extended or adjusted under 35 U.S.C. 154(b) by 174 days.

(21) Appl. No.: 09/609,592

(22) Filed: Jun. 30, 2000

Related U.S. Application Data

(60) Provisional application No. 60/142,076, filed on Jul. 2, 1999.

(51) Int. Cl.[7] ..... A47L 13/144

(52) U.S. Cl. ..... 15/119.2; 15/119.1; 15/120.1; 15/260; 15/263

(58) Field of Search ..... 15/116.1, 116.2, 15/119.1, 119.2, 228, 147.1, 260, 98, 120.1, 263

(56) References Cited

U.S. PATENT DOCUMENTS

| | | | | | |
|---|---|---|---|---|---|
| 2,108,727 | A | | 2/1938 | Rogers | 15/119 |
| 2,615,191 | A | | 10/1952 | Brown | 15/262 |
| 3,364,512 | A | * | 1/1968 | Yamashita et al. | 15/119.1 |
| 3,987,513 | A | | 10/1976 | Gonzales | 15/262 |
| 4,196,488 | A | | 4/1980 | Barry | 15/119 |
| 4,516,287 | A | | 5/1985 | Johnson et al. | 15/119 |
| 4,817,228 | A | * | 4/1989 | von Meyer | 15/119.2 |
| 4,875,246 | A | * | 10/1989 | MacGregor | 15/119.2 |
| 5,551,116 | A | * | 9/1996 | DeKelaita | 15/246 |
| 5,606,760 | A | * | 3/1997 | De Guzman | 15/119.2 |
| 5,657,503 | A | | 8/1997 | Caruso | 15/98 |
| 5,724,694 | A | * | 3/1998 | Lewis | 15/119.1 |

FOREIGN PATENT DOCUMENTS

| | | | | |
|---|---|---|---|---|
| EP | 0119964 | * | 9/1984 | 15/119.2 |

* cited by examiner

*Primary Examiner*—Gary K. Graham
(74) *Attorney, Agent, or Firm*—Sharon Roddan

(57) ABSTRACT

A mop having a self-contained and electrically powered wringer. The mop consists of an elongated, hollow handle wherein is placed a power unit. Attached to the power unit is a rod connected to a mop head consisting of an assembly of a cleaning device holder and a cleaning device. The preferred embodiment of the invention includes a housing for receiving the cleaning device holder. The housing in the preferred embodiment also includes movable rollers. The preferred embodiment is actuated by a switch causing electricity to flow to the power unit. The activated power unit causes a communicating spring acting against a spring stop to be fully retracted or projected. In the preferred embodiment, when the switch is released, the power unit causes the communicating spring to be fully projected. The process of retraction and projection of a cleaning device through the rollers results in the expulsion of water from the mop head. Also disclosed are alternative methods for the wringing mechanism of the mop.

5 Claims, 4 Drawing Sheets

MOP WITH BATTERY POWERED WRINGER

CROSS-REFERENCE TO RELATED APPLICATIONS

This application claims the benefit of U.S. Provisional Application No. 60/142,076 filed Jul. 2, 1999.

BACKGROUND-FIELD OF INVENTION

The present invention relates to a mop and more particularly to a novel battery powered wringer for a mop.

BACKGROUND-DESCRIPTION OF PRIOR ART

Mops are well known devices in the cleaning arts. Prior to the invention of the traditional and well-known mop, the cleaning person was required to be down on his or her hands and knees in order to clean a flooring surface. Since the invention of the traditional mop, the user is now able to stand while cleaning a floor.

It is without question that standing is preferred. Nevertheless, the user of the original mop had the particularly distasteful job of wringing out the mop head by hand. Therefore, over the years novel adaptations were made to improve the manner in which the user could wring fluid from the mop head.

U.S. Pat. No. 2,109,727 issued to Rogers in 1935 sets forth a novel means for extracting water from the mop head. Later, other patents such as U.S. Pat. No. 4,196,488 (Barry, 1980) and U.S. Pat. No. 4,516,287 (Johnson, 1985) further attempt to improve on the self-wringing mop. Although these various patents attempt to simplify the fluid extraction process, all of these patents share the same shortcoming . . . they require manual operation. Furthermore, they are difficult and messy to operate.

Other attempts at powered wringers for use with mops are found in U.S. Pat. No. 2,615,191 (Brown, 1952) and U.S. Pat. No. 3,987,513 (Gonzales, 1976). However, these patents require that the wringer be affixed to a bucket.

None of the inventions and patents describes the novel invention as claimed in this disclosure. It is obvious that a clear need exists for a mop with a battery-powered wringer. The invention of this disclosure provides an easy, efficient, simple, clean and cost-effective device to improve mop art. To this end, the teaching of this unique idea addresses a long-standing and unmet need.

SUMMARY OF THE INVENTION

It is the object of this invention to provide a mop that is electrically powered for the purpose of expelling water from a mop head. This novel invention overcomes the drawbacks of the prior art.

This invention has several features, no single one of which is solely responsible for its desirable attributes. Without limiting the scope of this invention as expressed by the claims which follow, its more prominent features will now be discussed briefly. After considering this discussion, and particularly after reading the section entitled "DETAILED DESCRIPTION OF THE PREFERRED EMBODIMENT," one will understand how the features of this invention provide its benefits and advantages.

More particularly, the invention provides an improved mop having a battery-powered wringer. Additionally, several other objectives and advantages of the present invention are as discussed in the following paragraphs.

The first feature of the invention is that it eliminates the need to manually extract fluid from a mop head.

The second feature of the invention eliminates the need for an externally located manual extraction means. This provides an added safety feature for the cleaning person, as the handle of the mop in this novel invention is essentially smooth.

The third feature of the invention replaces the external prior art manual extraction means with a simple switch.

The fourth feature of the invention is that the physical labor required for manual extraction is replaced by the action of a self-contained, electric or battery powered wringer. The invention is truly a labor saving device.

The fifth feature of the invention is that it avoids awkward wrist and body angles experienced with the prior art extraction means. This, too, provides an added safety feature for the user by eliminating common low back, wrist and hand injuries encountered with prior art mop wringers.

The sixth feature of the invention is that it reduces the proximity of the face of the user from the mop head. This is simply more sanitary and diminishes the users risk of exposure to bacteria and viruses.

The seventh feature of the invention is a reduction in fatigue since the manual operation of wringing the mop had has been replaced with a powered wringer. This might result in an increase in the stamina for the user.

The eight feature of the invention is that with less stress on the muscles of the hands, arms, back, neck and shoulders, cleaning people are more likely to relax during mopping sessions and avoid tightening or spasm of the muscles. The cleaning person can work for longer periods of time.

The ninth feature of the invention provides an electrically powered mop wringer without requiring the wringer to be affixed to a bucket.

The tenth feature of the invention is that it changes a difficult and unpleasant task into one that is more tolerable.

Because the operator is able to retract and project the mop head several times within a few seconds, the eleventh feature is that the invention provides a cleaner sponge or rag mop. The user can hold the head of the mop in a bucket of mopping fluid and operate the wringing mechanism several times within the bucket.

The twelfth feature of the invention provides the ability to automatically adjust the wetness of the sponge or rag mop based upon the number of times the operator elects to operate the wringing mechanism.

Furthermore, the disclosure which is the subject of this invention, will describe in detail this easy-to-use, efficient, simple, clean and cost-effective device to improve mop art devices and enable one skilled in the art to practice the invention.

BRIEF DESCRIPTION OF THE DRAWINGS

The accompanying drawings, which are for illustrative purposes only, include the following figures (FIGS.), with like numerals indicating like parts.

DESCRIPTION OF THE PREFERRED EMBODIMENT

Figure 1:
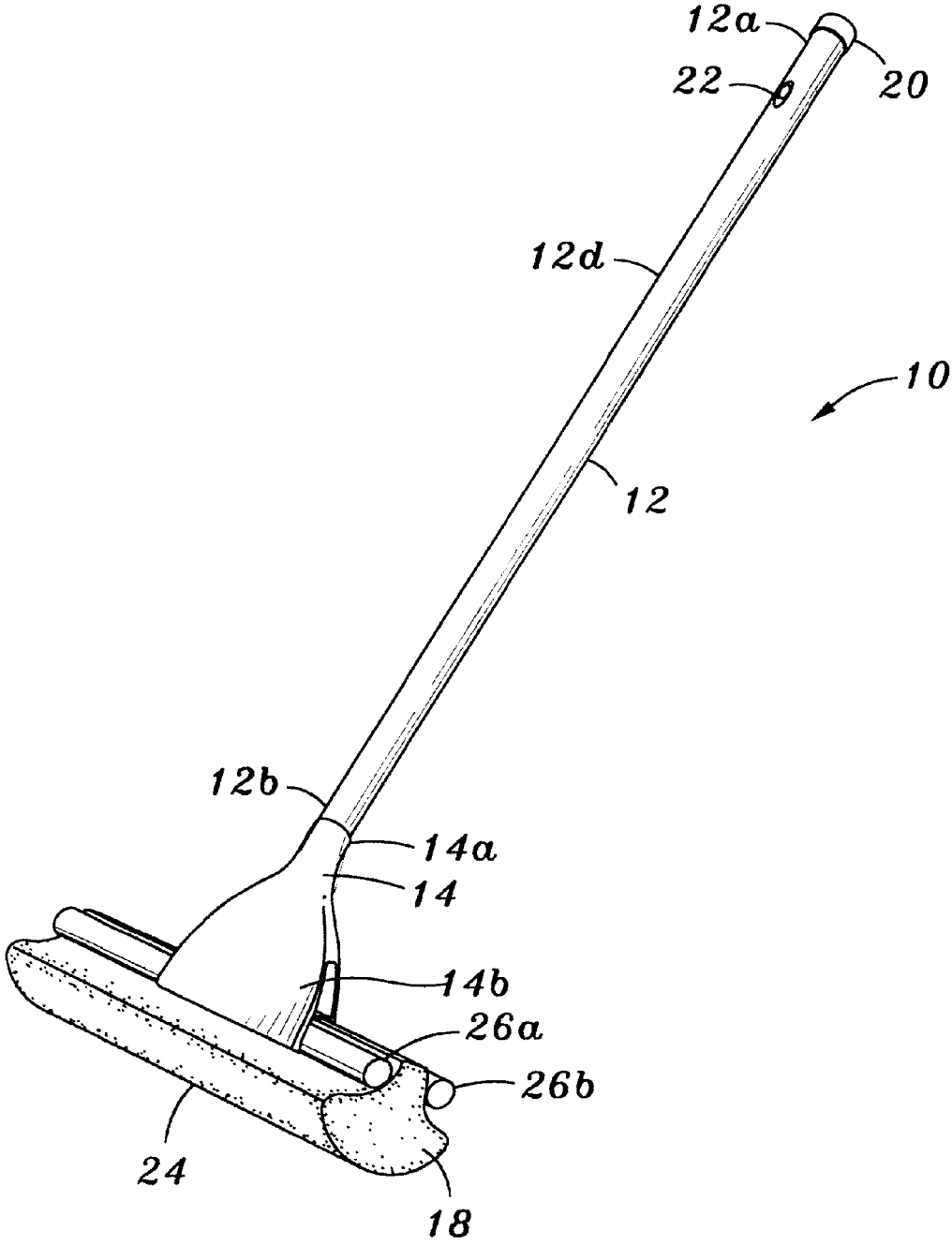
FIG. 1 is a perspective view of one embodiment of the invention.
Figure 4:
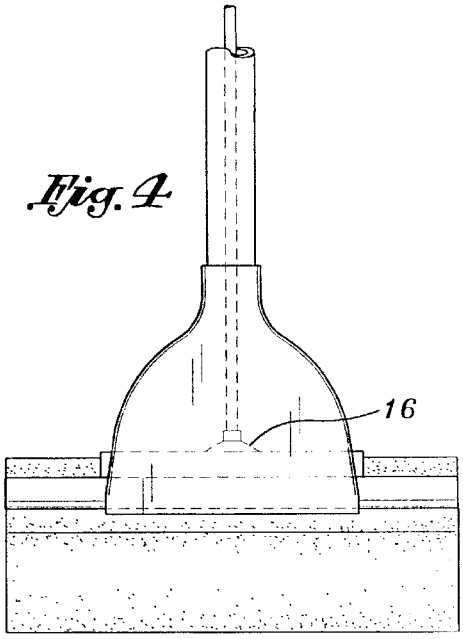
FIG. 4 is a fragmentary front elevational view of the mop holder and rollers within the housing.

FIG. 1 depicts the general features of the embodiments of the present invention which is mop with a powered wringer indicated generally by the reference numeral 10. The mop has the usual elongated, hollow handle 12 fabricated in the usual manner of wood, plastic, metal or other suitable material in accordance with the present invention. The exterior wall 12*d* of the handle may have a switch 22. The upper end 12*a* of the handle 12 may have a removable cap 20. The lower end 12*b* of the handle 12 of the mop 10 may have affixed thereto a mop head housing 14 which is affixed at the first end 14*a* of the mop head housing 14. The second end 14*b* of the mop head housing 14 may be in communication with a pair of rollers 26*a* and 26*b*. In the preferred embodiment the rollers 26*a* and 26*b* are attached to the bottom of the housing in a manner to permit rotation of the rollers. In addition, the housing 14 (see FIG. 4) receives a cleaning device holder which in the preferred embodiment is a sponge holder 16. The sponge holder 16 is affixed to the lower end 12*b* of the handle 12. A replaceable cleaning device, which in the preferred embodiment is a replaceable sponge 18, is affixed to the lower end of the holder 16. The replaceable sponge 18 may project downwardly (see FIG. 2) or downwardly at an angle (see FIG. 1). The assembly of the sponge holder 16 and the replaceable sponge 18 forms the mop head 24.

Figure 2:
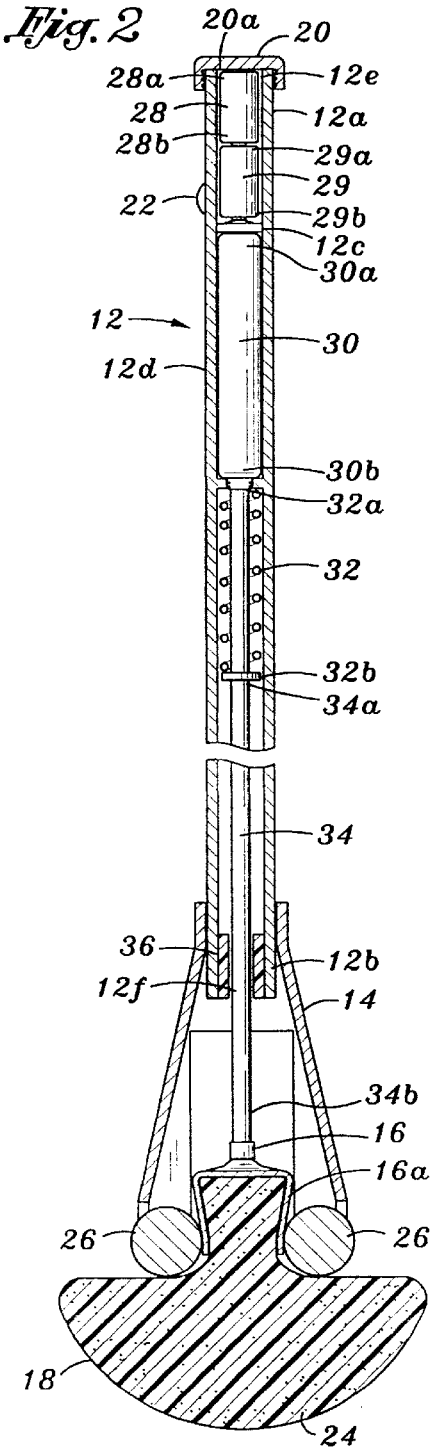
FIG. 2 is a sectional of view of a variation on the embodiment of the invention.
Figure 3:
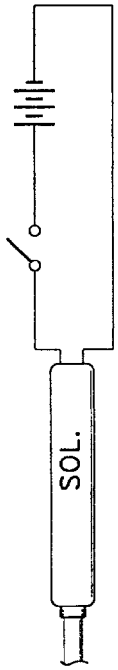
FIG. 3 is an enlarged detailed sectional elevation of the control switch for the power unit or solenoid of the preferred embodiment.
Figure 3A:
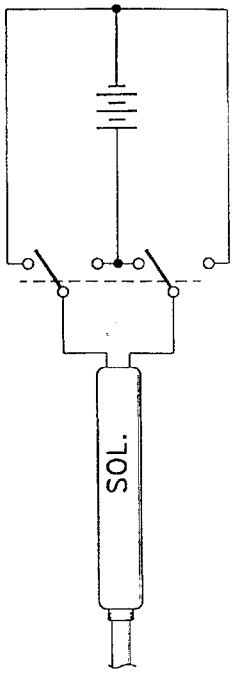
FIG. 3*a* is an enlarged detailed sectional elevation of the reverse polarity control switch for the power unit or solenoid of the alternative embodiment.

FIG. 2 further depicts an embodiment of the invention. In this drawing is shown the interior wall 12*c* of the handle 12 which forms a chamber within the longitudinal axis of the handle 12. At the upper end 12*e* of the interior wall 12*c* is the upper end 28*a* of battery 28, which may be in communication with the interior surface 20*a* of the cap 20. In another embodiment merely closing the upper end 12*a* of the handle 12 may eliminate the need for the cap 20. However, without a cap 20 an alternative opening would be required for placement of the batteries. In other embodiments the cap 20 or the handle 12 may actuate to serve as a switch for the power unit.

The invention is powered by a power unit which, in FIG. 2, is depicted as a spring loaded solenoid and batteries. This type of power unit is well known in the art. In addition, the power unit at a shown in FIGS. 5 and 6 may be a motor with a drive screw. This type of a power unit is also well-known the art. It is essential to practice this invention that there be some form of power unit in communication with some type of recoil.

Referring to FIG. 2, the lower end 28*b* of battery 28 is in communication with the upper end 29*a* of battery 29. The lower end 29*b* of battery 29 is in communication with the upper end 30*a* of a solenoid 30. The lower end 30*b* of the solenoid 30 is in communication with the upper end 32*a* of a spring 32. The lower end 32*b* of the spring 32 is in communication with a spring stop 33. The spring stop 33 is attached to a pull rod 34. The lower end 34*b* of the pull rod 34 is attached to the upper end 16*a* (see FIG. 4) of a sponge holder 16. The lower end 16*b* of the sponge holder 16 is designed to receive a replaceable sponge 18. At the lower end 12*f* of the interior chamber 12*c* of the handle 12 may be located a guide 36 for the pull rod 34. In addition, FIG. 2 shows the housing 14 retaining therein the sponge holder 16.

To wring out a wet mop, the mop head 24 is retracted by the action of the batteries 28 and 29 and a spring-loaded solenoid 30. As the current flows through and activates the solenoid 30, a connected pull rod 34 within the length of the handle 12 retracts the mop head 24 between the two stationary rollers 26 resulting in the expulsion of water (or fluid) from the mop head 24.

To activate the retraction of the mop head 24, the operator depresses a switch 22 (or button) on the handle 12. As the retraction occurs, the connected rod 34 within the solenoid 30 works against the spring 32 by means of a spring stop 33. When the mop head 24 is fully retracted, the spring 32 becomes fully loaded against the spring stop 33. At the point of full retraction, the operator releases the current to the solenoid 30 by releasing the switch 22 (or button). The loaded spring 32 is then free to project the head 24. An alternative embodiment utilizes a reversed polarity. In this alternative embodiment, the operator depresses a switch 22 (or button) on the handle 12 as the retraction occurs, the connected rod 34 within the solenoid 3 retracts the head of the mop. At the point of full retraction, the operator releases the switch 22 (or button) reversing the polarity of the solenoid 30 and this action will project the mop head 24. This reverse switch would disengage when the mop head reached its projected endpoint.

At full projection the head 24 may be locked in place by a latching mechanism (not shown). The latching mechanism may be released simultaneously as the button switch 22 is depressed to activate retraction. This system provides a quick and spontaneous response for retraction and projection as the button switch 22 is pressed and released and may be repeated easily several times during a period of a few seconds.

Figure 5:
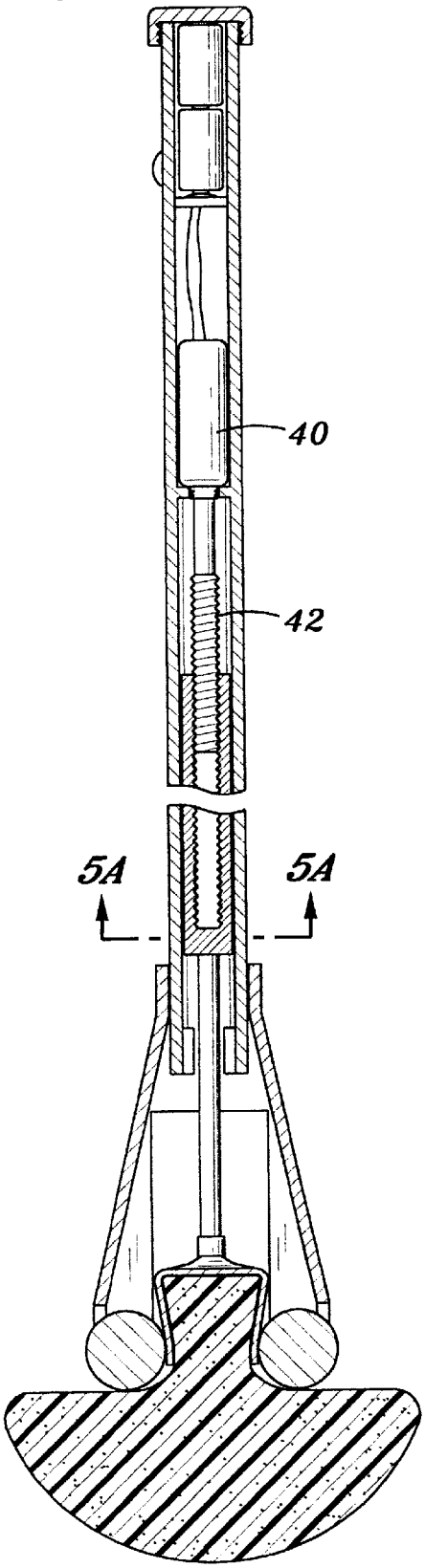
FIG. 5 is a sectional of view of a variation on the embodiment of the invention.
Figure 5A:
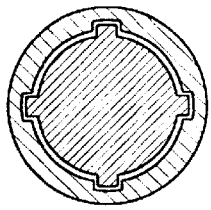
FIG. 5*a* is a cross-sectional view across plane 5A—5A.
Figure 6:
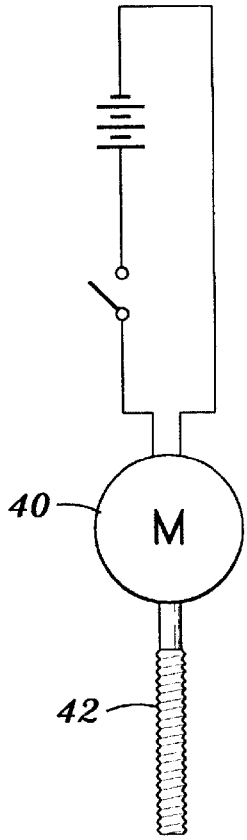
FIG. 6 is an enlarged detailed sectional elevation of the control switch for the power unit or motor of an alternative embodiment.

Another less preferred embodiment is shown in FIG. 5 and FIG. 6. Here a motor 40 and a screw drive 42 are used in place of solenoid and spring. Although not depicted, it is possible to have embodiment where in the recoil is in the fully loaded position when the power unit is not activated and unloads when the power unit is activated. It would be possible to have an embodiment wherein the mop head is retracted when the power unit is off.

Figure 7:
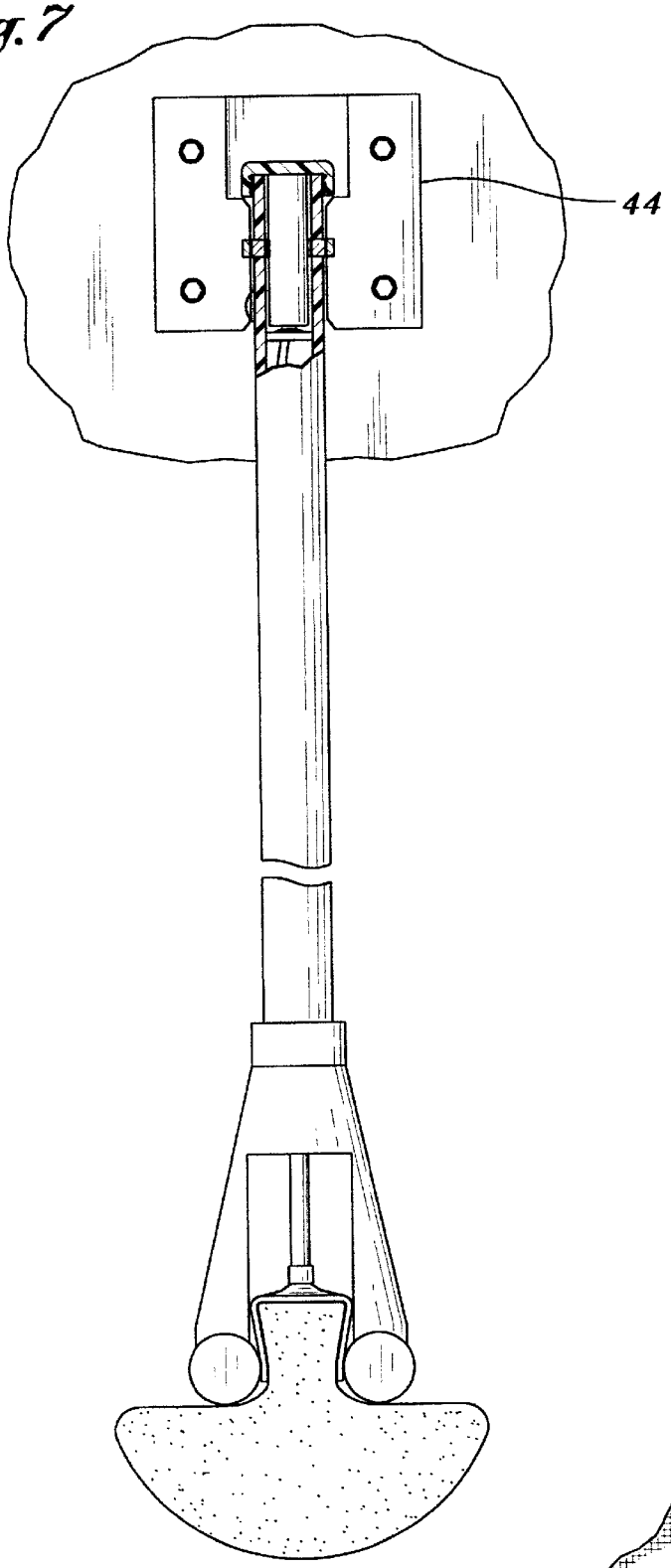
FIG. 7 depicts an alternative of the invention within a power charging unit.

FIG. 7 depicts the battery power in a rechargeable unit 44.

Figure 8:
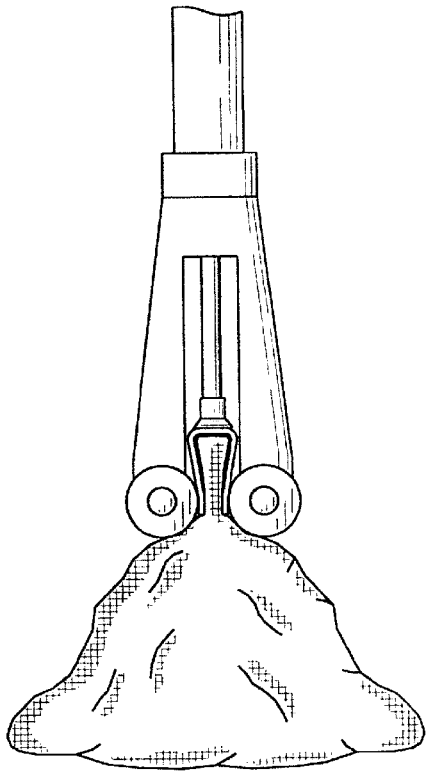
FIG. 8 is a sectional of view of a variation on the embodiment of the invention.

FIG. 8 depicts another embodiment for electrically wring a rag mop.

Other methods of electrically wringing sponge or rag mops are also mentioned. It is possible to practice the invention by alternating the order of the elements of the invention. In other words, it is possible, for example, to still practice the invention by having the cleaning device holder in communication with the spring. In addition, it would be possible to reverse the polarity of the switch and still practice the invention. In this instance, with the reverse switch, the use of a spring or recoil would not be required. This alternative embodiment requires less energy because the usual demand necessary for the recoil is eliminated. It is also within the contemplation of the invention to adapt either the housing or the cleaning device holder or both to actuate to provide for and include other types of wringing actions for sponge and rag mops. This includes but is not limited to such alternative embodiments as, for example, a clamping, squeezing or twisting type of wringer. Such alternative embodiments might also obviate the need for the rollers.

SCOPE OF THE INVENTION

The above-presented description is of the best mode contemplated for carrying out the present invention. The manner and process of making and using it is in such a full, clear, concise and exact terms as to enable to any person skilled in the art to which it pertains to make and use this invention.

This invention is however, susceptible to modifications and alternate constructions from that disclosed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims which particularly point out and distinctly claim the subject matter of the invention:

I claim:

1. A wringer mop comprising:

an elongated tubular handle extending along a longitudinal axis to define opposing first and second ends, said tubular handle defines a cavity therein and has a guide member mounted within said first end;

a housing coupled at an upper end thereof to said first end of said handle, a lower end of said housing has spaced squeeze rollers mounted thereon;

a solenoid mounted in said cavity;

an elongated pull rod provided in said cavity and extending from said first end of the handle passing through said guide member, said pull rod having an upper end coupled with said solenoid and having a lower end within said housing, said rod has a spring stop thereon which cooperates with a recoil spring provided within said cavity;

a mop element holder attached to said lower end of said pull rod;

a mop element received within said mop element holder and adapted to contact said rollers;

wherein actuation of said solenoid causes movement of said mop element along said longitudinal axis between the rollers for squeezing thereof.

2. The wringer mop of claim 1 wherein said mop element comprises a sponge mop.

3. The wringer mop of claim 1 wherein said mop element comprises a rag mop.

4. The wringer mop of claim 1 wherein said mop element holder is channel shaped.

5. A wringer mop having a solenoid for actuating linear movement of a mop element, said wringer mop comprising:

an elongated tubular handle extending along a longitudinal axis to define opposing first and second ends, said tubular handle defines a cavity therein and has a guide member mounted within said first end;

a housing coupled at an upper end thereof to said first end of said handle, a lower end of said housing has spaced squeeze rollers mounted thereon;

said solenoid mounted in said cavity;

an elongated pull rod provided in said cavity and extending from said first end of the handle passing through said guide member, said pull rod having an upper end coupled with said solenoid and having a lower end within said housing, said rod has a spring stop thereon which cooperates with a recoil spring provided within said cavity;

a mop element holder attached to said lower end of said pull rod;

said mop element received within said mop element holder and adapted to contact said rollers;

wherein actuation of said solenoid causes movement of said mop element along said longitudinal axis between the rollers for squeezing thereof.

* * * * *